US008997715B2

(12) United States Patent
Worthington et al.

(10) Patent No.: US 8,997,715 B2
(45) Date of Patent: Apr. 7, 2015

(54) COMMON RAIL SYSTEM WITH LEAK CONTAINMENT AND DETECTION

(75) Inventors: Joseph Worthington, Seymour, IN (US); Thomas O. Hahn, Columbus, IN (US); Vijay Sonawane, Pune (IN); Prasad Khedekar, Pune (IN); Dave Richter, Columbus, IN (US); Josh Knight, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 971 days.

(21) Appl. No.: 13/103,066

(22) Filed: May 8, 2011

(65) Prior Publication Data

US 2012/0006297 A1 Jan. 12, 2012

Related U.S. Application Data

(60) Provisional application No. 61/332,524, filed on May 7, 2010.

(51) Int. Cl.

| | |
|---|---|
| ***F02M 69/46*** | (2006.01) |
| ***F02M 55/02*** | (2006.01) |
| ***F02M 37/00*** | (2006.01) |
| ***F02M 55/00*** | (2006.01) |
| ***F02M 65/00*** | (2006.01) |

(52) U.S. Cl.

CPC ..... *F02M 55/025* (2013.01); *F02M 37/0052* (2013.01); *F02M 55/00* (2013.01); *F02M 65/006* (2013.01)

(58) Field of Classification Search

CPC ..... B67D 7/3209; B67D 7/78

USPC ..... 73/40; 123/198 D, 456, 468, 514, 469, 123/445, 447

See application file for complete search history.

(56) References Cited

U.S. PATENT DOCUMENTS

| | | | | |
|---|---|---|---|---|
| 4,149,568 | A | 4/1979 | Kuntz et al. | |
| 6,286,556 | B1 | 9/2001 | Kato | |
| 6,827,065 | B2 * | 12/2004 | Gottemoller et al. | 123/456 |
| 7,337,652 | B2 | 3/2008 | Shamine | |
| 2005/0166899 | A1 * | 8/2005 | Shamine et al. | 123/456 |
| 2005/0235964 | A1 * | 10/2005 | Shibata | 123/458 |
| 2006/0130560 | A1 * | 6/2006 | Shamine | 73/40 |
| 2010/0192910 | A1 * | 8/2010 | Toyoshima | 123/456 |

FOREIGN PATENT DOCUMENTS

| | | |
|---|---|---|
| EP | 2011996 A1 | 1/2009 |

* cited by examiner

*Primary Examiner* — Mahmoud Gimie
*Assistant Examiner* — Sizo Vilakazi
(74) *Attorney, Agent, or Firm* — Faegre Baker Daniels LLP

(57) ABSTRACT

This disclosure provides a fuel system for supplying fuel to an internal combustion engine, an internal combustion engine that includes such a fuel system, a connector for connecting a single-walled high pressure common rail to a double-walled fuel line segment, and a fluid containment system. Each embodiment includes drain plumbing having a leakage drain connector that can be used to provide an interface between a single-walled high pressure common rail and a double-walled high pressure fuel line segment, and also provide part of a low pressure passage fluidly connected with a low pressure passage of the double-walled high pressure fuel line segment. The drain plumbing also can provide an interface with a low pressure fuel drain line fluidly coupled to a leakage detector.

26 Claims, 3 Drawing Sheets

COMMON RAIL SYSTEM WITH LEAK CONTAINMENT AND DETECTION

RELATED APPLICATIONS

This application claims benefit of priority to Provisional Patent Application No. 61/332,524, filed on May 7, 2010, the entire contents of which are hereby incorporated by reference.

FIELD OF THE INVENTION

The inventions relate to fluid leak containment plumbing, and more particularly, to a high pressure fluid system, such as a fuel system of an internal combustion engine, and a fluid system component, that can contain and detect leaking fluid.

BACKGROUND

To safely deliver fuel in high pressure systems, modern fuel systems include measures to contain fuel leaks that may occur. For example, marine agency requirements such as the International Convention for the Safety of Life at Sea (SOLAS) treaty require double-walled fuel lines to prevent the likelihood of fire on a commercial marine vessel. These double-walled fuel lines must include a gap between the inner and outer walls to allow any fuel leaked from the inner wall to be detected by a fuel sensor while being contained by the outer wall.

SUMMARY

This disclosure provides a fuel system for use with an internal combustion engine and an internal combustion engine including such a fuel system, each of which include a single-walled high pressure common rail, plural double-walled high pressure fuel lines that include a low pressure leak containment passage, and drain plumbing that includes leakage drain connectors forming interfaces between the single-walled high pressure common rail and respective ones of the double-walled high pressure fuel lines and forming part of the low pressure containment passage. This disclosure also provides a connector for interfacing a single-walled high pressure common rail with a double-walled fuel line, and a leak containment system for containing fuel or other types of fluids delivered from one place to another under high pressure.

In an embodiment, a fuel system for supplying fuel to an internal combustion engine includes a single-walled high pressure common rail including a main body and plural members extending from the main body, where each member has a high pressure passage leading to the main body. The system includes plural double-walled fuel line segments adapted to fluidly connect the high pressure passages of the single-walled high pressure common rail to respective plural fuel injectors, where each segment includes a high pressure fuel line, a jacket surrounding the high pressure fuel line, a low pressure passage between the high pressure fuel line and the jacket, and a fuel line connector. The fuel line connector includes a main body housing a portion of the high pressure fuel line such that an end portion of the high pressure fuel line protrudes from a first end of the main body and a second end of the main body is sealingly connected to the jacket to thereby extend the low pressure passage into the fuel line connector. The system includes plural leakage drain connectors, where each of the leakage drain connectors is sealingly connected at a first end portion thereof to one of the members, and sealingly connected at a second end portion thereof to one of the plural fuel line connectors. In this way, the protruding end portion of the high pressure fuel line sealingly engages with the high pressure passage of the member, and the low pressure passage of the fuel line connector extends through the leakage drain connector to an opening at an outer surface of the leakage drain connector. A fuel drain line fluidly is coupled to each of the openings of the plural leakage drain connectors.

In another embodiment, an internal combustion engine includes a plurality of cylinders and plural fuel injectors, where each of the cylinders is associated with one of the fuel injectors. The engine includes a single-walled high pressure common rail including a main body and plural members extending from the main body, where each member has a high pressure passage leading to the main body. The engine includes plural double-walled fuel line segments, where each of the segments has a high pressure fuel line, a jacket surrounding the high pressure fuel line portion, a low pressure passage between the high pressure fuel line and the jacket, a first end fluidly connected to a respective one of the fuel injectors, and a fuel line connector including a main body. The fuel line connector houses a portion of the high pressure fuel line such that an end portion of the high pressure fuel line protrudes from a first end of the main body and a second end of the main body is sealingly connected to the jacket to thereby extend the low pressure passage into the fuel line connector. The engine includes plural leakage drain connectors, where each leakage drain connector is sealingly connected at a first end portion thereof to one of the members, and is sealingly connected at a second end portion thereof to one of the plural fuel line connectors. In this way, the protruding end portion of the high pressure fuel line sealingly engages with the high pressure passage of the member, and the low pressure passage of the fuel line connector extends through the leakage drain connector to an opening at an outer surface of the leakage drain connector. A fuel drain line fluidly coupled to each of the openings of the plural leakage drain connectors.

In another embodiment, a connector for connecting a single-walled high pressure common rail to a double-walled fuel line includes a main body having a first opening substantially aligned along a longitudinal axis of the main body and is configured to sealingly attach to a member extending from a single-walled high pressure common rail, and a second opening opposite the first opening and configured to sealingly attach to a connector of a double-walled high pressure fuel line such that the high pressure portion of the double-walled fuel line seals with the member to form a continuous high pressure passage. The at least one third opening provided along a direction substantially orthogonal to the longitudinal axis. A fuel collection manifold is around the main body and has a channel between the third opening and an outer surface of the fuel collection manifold such that a low pressure passage for fuel leaking from the double-walled fuel line extends from the channel through the third opening.

In yet another embodiment of the disclosure, a leak containment system includes a single-walled high pressure accumulator including a high pressure cavity, a double-walled line including a high pressure line, a jacket surrounding the high pressure line, an annular region between the high pressure line and the jacket, and a line connector housing a portion of the double-walled line and configured to fluidly attach the double-walled line to the single-walled high pressure accumulator, a drain line, and a leakage drain connector having a first end sealingly attached to the single-walled high pressure accumulator, a second end sealingly attached to the line connector, and a side portion fluidly connected to the leakage drain line. The leakage drain connector houses a portion of the high pressure line. A leakage detector is fluidly coupled to the drain line. In the system, a continuous high pressure passage is formed that includes the high pressure cavity fluidly connected to the high pressure line, and a continuous low pressure passage is formed that includes the annular region, the drain line, and interior regions of the leakage drain connector and the line connector outside the housed high pressure line.

DETAILED DESCRIPTION

The inventors have realized that known single-walled high pressure common rails (i.e., accumulators) and/or designs of high pressure common rails that would be commonly available can be made to interface with a bank of double-walled fuel injection lines and meet marine agency safety requirements. More specifically, drain plumbing described herein provides an interface between a single-walled high pressure common rail and a double-walled high pressure line (e.g., a fuel injector line) that avoids complicated and expensive designs that would require developing a double-walled high pressure common rail, while also providing a structure that can contain and detect fluid leaks.

Figure 1A:
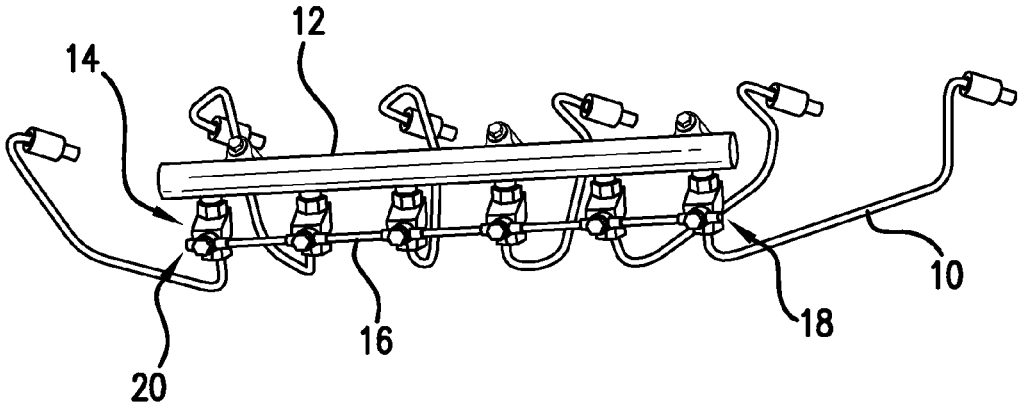
FIGS. 1A and 1B are perspective diagrams of a fuel system according to an exemplary embodiment.
Figure 1B:
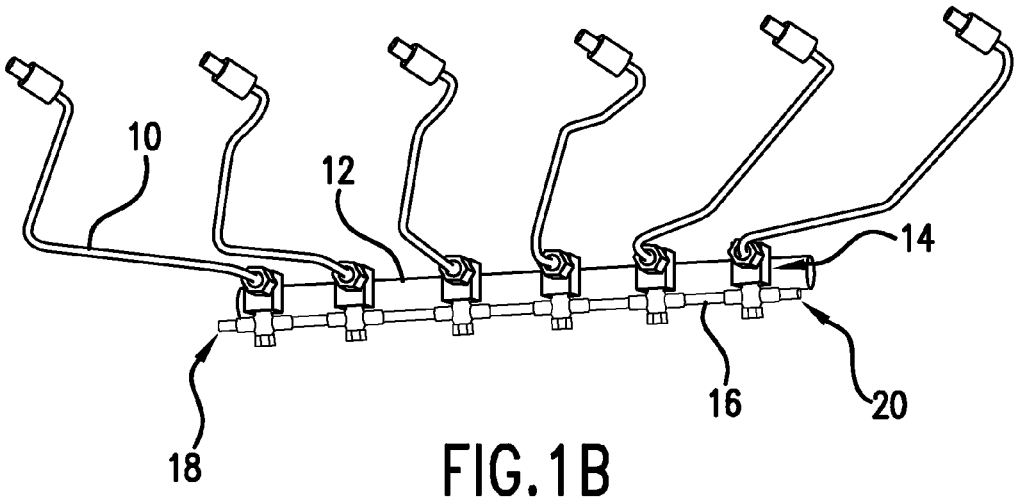

FIGS. 1A and 1B show perspective diagrams of a fuel system according to an exemplary embodiment. As shown in FIGS. 1A and 1B, the fuel system includes plural double-walled fuel line segments 10 that fluidly couple with a high pressure cavity of a single-walled common rail 12 (i.e., accumulator). The high pressure cavity of the common rail 12 receives fuel at high pressure from a high pressure fuel pump and temporarily stores fuel at high pressure so it is available to injectors (not shown) attached to the double-walled fuel line segments. The fuel system includes drain plumbing 14 positioned between the common rail 12 and the fuel line segments 10. The drain plumbing 14 provides an interface between the double-walled fuel line segments 10 and the high pressure common rail 12 that allows containment, collection and/or detection of fuel leaked from high pressure elements of the fuel system.

More specifically, the drain plumbing 14 includes a fuel drain line 16 into which fuel leaking from any of the double-walled fuel injector lines 10 flows. Leaking fuel in the fuel drain line 16 is directed to a leakage detector (not shown) that detects the leaking fuel. For example, one end 18 of the fuel drain line 16 can be provided with or fluidly coupled to a fuel leakage detector, such as a tell tale sensor element, flow meter, pressure or vacuum sensor, float switch, or a low pressure fuel sensor, and the other end 20 of the fuel drain line 16 can be capped or connected to a fuel drain line of another bank of plural double-walled fuel line segments 10, drain plumbing 14 and injectors.

The fuel drain line 16 is part of a low pressure circuit also including the outer walls of the plural double-walled fuel line segments 10 and the outer walls of the drain plumbing 14, which contains the leaking fluid so it can be directed back in one or more conduits to the fuel tank, the fuel pump, and/or another storage tank or container (not shown). A detected leak can trigger activation of a visual and/or audible alarm, a message (e.g., email, text) or another indication or notification mechanism. For example, a leakage detector can be monitored by an ECM (engine control module), which upon receiving a signal indicating a leakage event, triggers an audible alarm or visual alarm on a display to alert an operator of the engine.

Although the fuel system embodiment of FIGS. 1A and 1B is shown as including a combination of six pairs of double-walled fuel line segments 10 and corresponding drain plumbing 14 elements, other applications can include embodiments that group these pairs in various configurations. For example, embodiments can include as little as one pair corresponding to a single fuel injector and engine cylinder, a group of pairs corresponding to all of the cylinders an engine, an entire bank of an engine's cylinders, or any predetermined number of pairs in any predetermined number of groups where each group corresponds to a subgroup of an engine's cylinders. Further, each group can include a fuel drain line that fluidly communicates with a detection element shared by plural groups or with detection element corresponding to only that group.

Figure 2A:
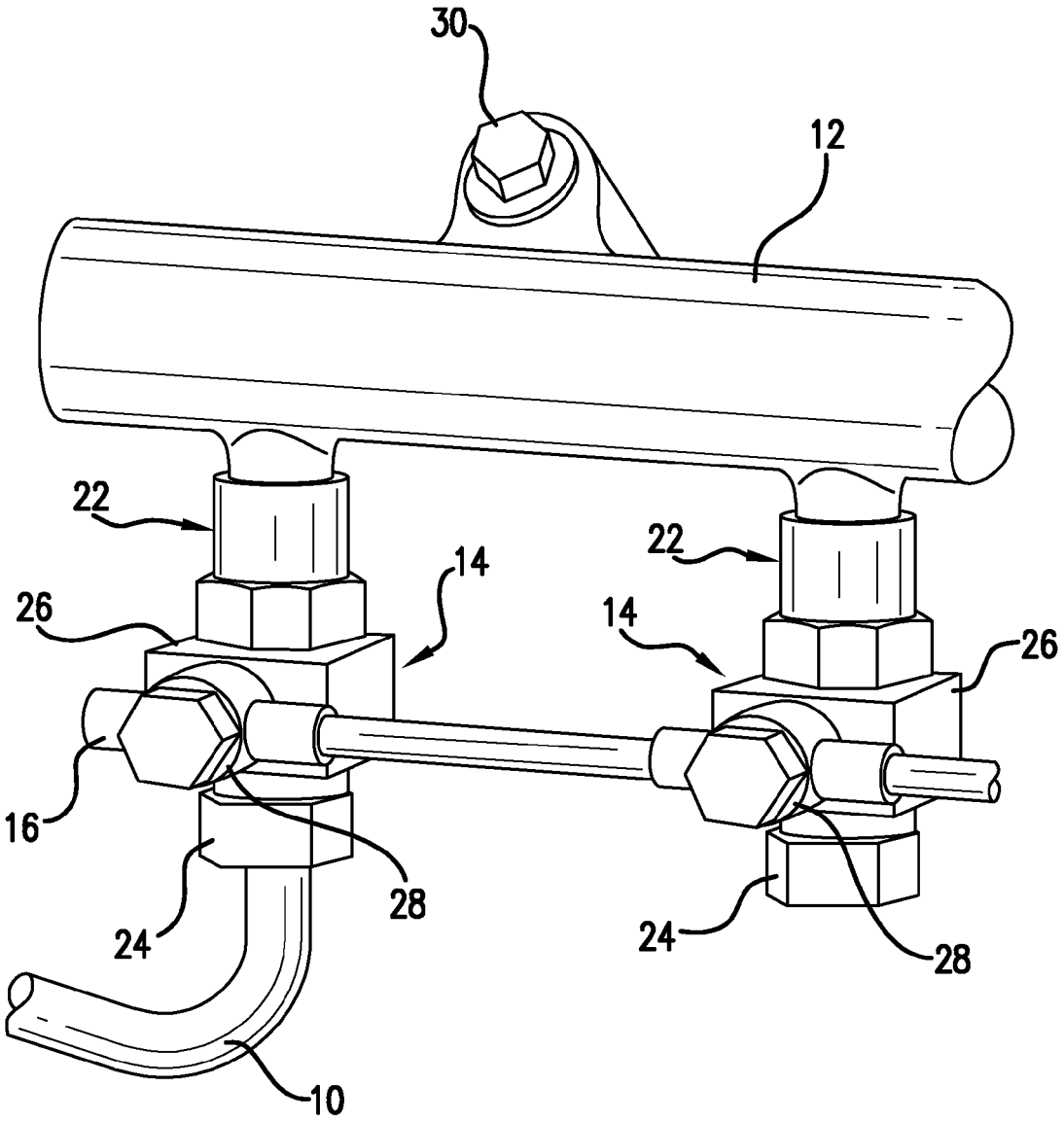
FIG. 2A is a more detailed perspective diagram of a portion of the fuel system shown in FIGS. 1A and 1B including a single-walled high pressure common rail, drain plumbing and high pressure double-walled fuel lines.
Figure 2B:
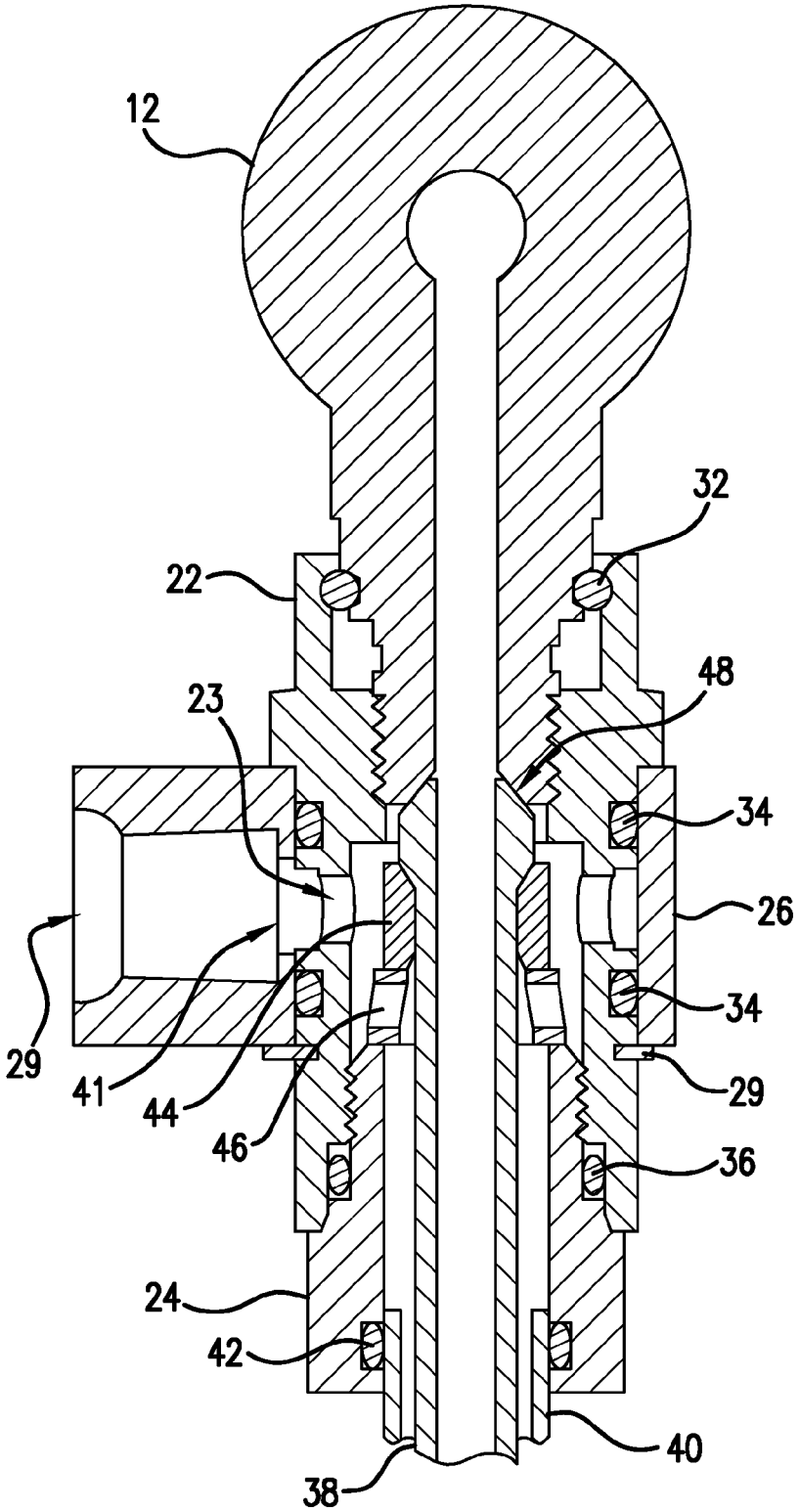
FIG. 2B is a diagram showing a cross section of the high pressure common rail, drain plumbing and the high pressure double-walled fuel lines shown in FIG. 2A.

FIGS. 2A and 2B show a more detailed view of a portion of the fuel system configuration depicted in FIGS. 1A and 1B. As shown in FIG. 2A, each drain plumbing 14 is provided at an end of a respective double-walled fuel line segment 10 of a bank of the fuel injector lines to fluidly couple the single-walled common rail 12 to a respective double-walled fuel line segment 10, each of which includes a fuel line connector 24, or sometimes called a high pressure fuel line nut 24 housing a portion of the double-walled fuel line segment 10. Each drain plumbing 14 includes a leakage drain connector 22 sealingly connected to the single-walled common rail 12 and to a fuel line connector 24, and a fuel collection manifold 26 housing a portion of the high pressure fuel line and sealingly engaged with the leakage drain leakage drain connector 22 to collect and contain any fuel leaked from high pressure lines of the double-walled fuel line segments 10. Each fuel collection manifold 26 is fluidly connected to the fuel drain line 16 that can include, for example, banjo connectors 28 that for interfaces with surfaces of the fuel collection manifold to provide a path for fuel leaking from high pressure fuel line of the double-walled fuel line segments 10 to a leakage detector (not shown) fluidly coupled with the fuel drain line 16, although fuel leaking from the injector also can be channeled into the low pressure circuit. The single-walled common rail 12 can include one or more mounting structures 30 to secure the single-walled common rail 12 and other fuel system elements attached to the single-walled common rail 12 to an internal combustion engine or other supporting structure (not shown).

FIG. 2B is a cross sectional view of the single-walled common rail 12, a leakage drain connector 22 sealingly attached to one of plural members (e.g., a nipple) extending from the single-walled common rail 12, a fuel collection manifold 26, and a double called fuel injection line. In the embodiment shown in FIG. 2B, the leakage drain connector 22 includes a main body including a threaded opening at each end of the main body along the longitudinal axis of the main body. Each fuel collection manifold 26 can include a surface 29 at which a banjo fitting 28 of the fuel drain line 16 (not shown in FIG. 2B) is sealingly engaged.

The fuel collection manifold 26 is retained at a predetermined longitudinal position on the leakage drain connector 22 by a bump out portion forming a nut head at one end of the leakage drain leakage drain connector 22, which provides a stop preventing insertion of the main body of the leakage drain connector 22 into the fuel collection manifold 26 beyond the predetermined longitudinal position along the direction of the longitudinal axis of the connector 22. The leakage drain connector 22 is retained on its other end by a retaining clip element 29 (e.g., a c-clip) engaged with a profile feature on the leakage drain connector 22, which is shown as slot formed in a surface of the outer wall of the leakage drain connector 22. It is to be appreciated that a configuration for retaining the fuel collection manifold 26 different from one having a retaining clip can be used, such as a retaining nut, pin etc. used in combination with a profile feature such as a slot, hole threads, or another profile element positioned on an outer surface of the main body to secure the leakage drain connector 22 at the predetermined position. In a preferred embodiment, the fuel collection manifold 26 is rotatable about and relative to the leakage drain leakage drain connector 22 to facilitate aligning plural fuel collection manifolds 26 to be connected to a single fuel drain line 16.

In another embodiment, the fuel collection manifold 26 may be an integrally formed portion of the leakage drain connector 22. In another embodiment, no manifold is provided, and the drain line 16 is connected to a surface of the leakage drain connector 22.

FIG. 2B also shows details of an embodiment of a double-walled fuel line segment 10, which has a configuration that contains fuel leaking from a high pressure fuel line of the double-walled fuel line. More specifically, the double-walled fuel line segment 10 includes a high pressure fuel line 38 forming an inner wall, and a low pressure fuel line or jacket 40 forming an outer wall surrounding the inner wall of the double-walled fuel line structure. The inner surface of the jacket 40 and the outer surface of the high pressure fuel line 38 can be tubular such that they define an annular area or passage therebetween. Although not shown, the double-walled fuel line segments 10 also can include one or more spacers between the high pressure fuel line 38 and the jacket 40, which are periodically spaced from another to maintain some uniformity to the annular area. Additionally, the spacers can include passages therethrough that allow leaking fuel to pass. The annular passage thus formed provides a low pressure passage relative to a high pressure passage formed by the high pressure fuel line 38 (i.e., when fuel is present in that line portion) and defines an area into which fuel leaking from the high pressure fuel line 38 can enter to be contained and detected. The low pressure region extending through the double-walled fuel line segment 10 is a portion of the larger continuous low pressure circuit that includes low pressure passages in the interior of the high pressure nut 24, in the interior of the leakage drain connector 22, in a channel of the fuel collection manifold 26, and in the fuel drain line 16. However, because the single-walled high pressure common rail 12 does not include an enclosed low pressure region surrounding its high pressure cavity, the low pressure circuit is terminated in the direction of the high pressure common rail 12 by the sealing engagement of the leakage drain connector 22 with a member of the high pressure common rail 12.

Each leakage drain connector 22 can include at least one opening 23 that opens in a direction substantially orthogonal to the longitudinal axis of the main body of the connector 22 to allow the low pressure passage in the leakage drain connector 22 to fluidly communicate with a low pressure channel 41 provided in the fuel collection manifold 26. For each double-walled fuel line segment 10, fuel leaking from a high pressure inner wall portion 38 can enter the channel 41 of the corresponding fuel collection manifold 26, and the channels 41 of all the fuel collection manifolds 26 in a bank of double-walled fuel lines 10 are fluidly connected to a low pressure passage in fuel drain line 16. Because fuel leaks from any of the high pressure fuel lines 38 of the plural double-walled fuel line segments 10 are directed to a single fuel drain line 16 in this embodiment, a single fuel leakage detector (e.g., a single sensor) can be used to detect any fuel leaked from any one of the high pressure fuel lines 38.

As shown in FIG. 2B, a mechanical, conical seal 48 can be used to seal fuel between the high pressure line 38 of the double-walled fuel line segment 10 by compressing an end portion of the high pressure fuel line 38 protruding from an end of the main body of the high pressure nut 24 with a complementary surface formed in a nipple of the single-walled common rail (accumulator) 12. The high pressure fuel line 38 can use a high pressure fuel line sleeve 44 and high pressure fuel line spacer 46 to transfer force to the conical end of the protruding potion of the high pressure inner wall as the high pressure fuel line nut 24 in threaded engagement with the leakage drain connector 22 is tightened, to allow mechanical sealing of the high pressure fuel line 38 to the member single-walled common rail (accumulator) 12. With the conical seal 48 in sealing engagement, a high pressure circuit includes the cavity of the single-walled high pressure common rail, a high pressure passage in the member leading to the cavity, and the high pressure fuel line 38. The high pressure fuel line spacer 46 includes passages, for example, holes drilled through the spacer, that allow leaked fuel at low pressure present in an annular passage between the high pressure fuel line 38 and inner wall of the jacket portion 40 to pass between a low pressure passage in the high pressure fuel line nut 24 and a low pressure passage in the leakage drain connector 22. From the low pressure passage in the leakage drain connector 22, the leaked fuel can pass through opening 24 to the channel 41 and thereafter to the fuel drain line 16.

In the exemplary embodiment shown in FIG. 2B, O-ring seals are used to seal interfaces in the low pressure system circuit, although other gasket or sealing elements can be used to provide sealing engagement between elements of the fuel system. For example, O-ring seals 32 can be used to seal any leaking fuel between the single-walled common rail 12 and leakage drain connector 22 to seal fuel from the common rail (accumulator) 12; O-ring seals 34 can be used between the fuel collection manifold 26 and leakage drain connector 22 to seal fuel from outside of the fuel collection manifold 26 while preferably allowing rotation of the fuel collection manifold 26; O-ring seals 36 can be used between the leakage drain connector 22 and high pressure fuel line nut 24 to seal fuel from the outer diameter of the high pressure fuel line nut 24; and O-ring seals 42 can be used between the jacket portion 40 of the high pressure fuel line 10 and high pressure fuel line nut 24 to seal any leaking fuel in the low pressure passage formed by the high pressure fuel line nut 24 and the annular area between the jacket portion 40 and the high pressure fuel line 38 of the fuel injection line 10.

Embodiments consistent with the disclosure allow the common rail (accumulator) 12 to remain single-walled, which simplifies design and facilitates cost savings. For example, without plural fuel collection manifolds 26 being plumbed together using a single fuel drain line 16 and a single fuel sensor (not shown), a more complicated, expensive design of a unique double-walled common rail (accumulator) would be required to allow for use of a single fuel sensor. Furthermore, the single-walled common rail 12 is compliant with requirements such as SOLAS, because a common rail is considered by marine agencies to be substantial fuel system component (i.e., not a fuel line), and thus it is not required for the common rail 12 to be double-walled. Additionally, embodiments consistent with the disclosure allow use of a single fuel sensor to detect a fuel leak from any of the inner walls of the bank of plural fuel injection lines.

In an exemplary embodiment described above, the fuel drain line 16 is a single tube structure including banjo connectors. However, the low pressure nature of the leaking fuel allows for embodiments having another configuration. For example, a fuel drain line can include plural sections (not shown) attached by compression fittings, for example, between a tee plumbing fitting or flexible lines having compression fitting at each end that mate with complementary fittings on one of opposite sides of a fuel collection manifold 26.

While an exemplary embodiment is described in the context of a marine internal combustion engine, for example, high horsepower diesel fuel systems, the same concepts can be applied to other applications of internal combustion engines, such as those used in wheeled vehicles, construction equipment, standby generators etc. Further, embodiments of the fuel system described herein can be used in applications including any type of internal combustion engine cylinder bank configuration, such as in-line, v-type or horizontally opposed. Additionally, the system described herein can be used to contain and detect leaks of fluids in applications using fluids other than fuels, where the fluids are stored at high pressure in an accumulator to be distributed to double walled lines.

Although a limited number of embodiments is described herein, one of ordinary skill in the an will readily recognize that there could be variations to any of these embodiments and those variations would be within the scope of the appended claims. Thus, it will be apparent to those skilled in the art that various changes and modifications can be made to the common rail fuel system with leak containment and detection described herein without departing from the scope of any appended claim and its equivalents.

What is claimed is:

1. A fuel system for supplying fuel to an internal combustion engine, comprising:

a single-walled high pressure common rail including a main body and plural members extending from the main body, each member having a high pressure passage leading to the main body;

plural double-walled fuel line segments adapted to fluidly connect the high pressure passages of the single-walled high pressure common rail to respective plural fuel injectors, each said segment including a high pressure fuel line, a jacket surrounding the high pressure fuel line, a low pressure passage between the high pressure fuel line and the jacket, and a fuel line connector housing a portion of the high pressure fuel line such that an end portion of the high pressure fuel line protrudes from a first end of the fuel line connector and a second end of the fuel line connector is sealingly connected to the jacket to thereby extend the low pressure passage into the fuel line connector;

plural leakage drain connectors coupled to an outer surface of the fuel line connector, each said leakage drain connector sealingly connected at a first end portion thereof to one of the members and sealingly connected at a second end portion thereof to one of the plural fuel line connectors, such that the protruding end portion of the high pressure fuel line sealingly engages with the high pressure passage of the member and the low pressure passage of the fuel line connector extends through the leakage drain connector to an opening at an outer surface of the leakage drain connector; and a fuel drain line fluidly coupled to each of said openings of the plural leakage drain connectors.

2. The internal combustion engine of claim 1, further comprising plural fuel collection manifolds, each said fuel collection manifold provided around a respective one of the leakage drain connectors and comprising: an outer surface; and a channel fluidly connecting the opening at an outer surface of the leakage drain connector to the outer surface of the fuel collection manifold such that the low pressure passage in the leakage drain connector extends to the outer surface of the fuel collection manifold.

3. The internal combustion engine of claim 2, wherein each said fuel collection manifold is detachably and sealingly engaged with the respective leakage drain connector.

4. The fuel system of claim 3, wherein each said fuel collection manifold is rotatable about the leakage drain connector to which it is sealingly engaged.

5. The fuel system of claim 1, wherein the fuel drain line extends the low pressure passage from the plural leakage drain connectors and is fluidly coupled to a fuel leakage detector.

6. The fuel system of claim 5, further comprising an alarm triggerable with detection of a fuel leak in the low pressure passage by the fuel detector.

7. The fuel system of claim 1, wherein each fuel line connector includes a spacer supporting a portion of the high pressure fuel line including the protruding end, said spacer including at least one passage through which the low pressure passage in the fuel line connector extends into the leakage drain connector.

8. An internal combustion engine, comprising:

a plurality of cylinders;

plural fuel injectors, each said cylinder associated with one of the fuel injectors;

a single-walled high pressure common rail including a main body and plural members extending from the main body, each member having a high pressure passage leading to the main body;

plural double-walled fuel line segments, each said segment having a high pressure fuel line, a jacket surrounding the high pressure fuel line portion, a low pressure passage between the high pressure fuel line and the jacket, a first end fluidly connected to a respective one of the fuel injectors, and a fuel line connector including a main body housing a portion of the high pressure fuel line such that an end portion of the high pressure fuel line protrudes from a first end of the main body and a second end of the main body is sealingly connected to the jacket to thereby extend the low pressure passage into the fuel line connector;

plural leakage drain connectors, a portion of each leakage drain connector being positioned longitudinally intermediate a respective one of the fuel line connectors and a respective one of the plural members of the single-walled high pressure common rail, and each said leakage drain connector sealingly connected at a first end portion thereof to one of the members and sealingly connected at a second end portion thereof to one of the plural fuel line connectors, such that the protruding end portion of the high pressure fuel line sealingly engages with the high pressure passage of the member and the low pressure passage of the fuel line connector extends through the leakage drain connector to an opening at an outer surface of the leakage drain connector; and a fuel drain line fluidly coupled to each of said openings of the plural leakage drain connectors.

9. The internal combustion engine of claim 8, further comprising plural fuel collection manifolds, each said fuel collection manifold is provided around a respective one of the leakage drain connectors and comprising: an outer surface; and a channel connecting the opening at the outer surface of the leakage drain connector to the outer surface of the fuel collection manifold such that the low pressure passage in the leakage drain connector extends to the outer surface of the fuel collection manifold.

10. The internal combustion engine of claim 9, wherein each said fuel collection manifold is detachably and sealingly engaged with the respective leakage drain connector.

11. The internal combustion engine of claim 10, wherein each said fuel collection manifold is rotatable about the leakage drain connector to which it is sealingly engaged.

12. The internal combustion engine of claim 8, wherein the fuel drain line forms an extension of low pressure passage from the plural leakage drain connectors and is fluidly coupled to a fuel leakage detector.

13. The internal combustion engine of claim 12, further comprising an alarm triggerable with detection of a fuel leak in the low pressure passage by the fuel detector.

14. The fuel system of claim 8, wherein each fuel line connector includes a spacer supporting the protruding end portion of the high pressure fuel line, said spacer including at least one passage through which the low pressure passage in the fuel line connector extends into the leakage drain connector.

15. A connector for connecting a single-walled high pressure common rail to a double-walled fuel line, said connector comprising:

a main body comprising:

a first opening substantially aligned along a longitudinal axis of the main body and configured to sealingly attach to a member extending from a single-walled high pressure common rail;

a second opening opposite the first opening and configured to sealingly attach to a connector of a double-walled high pressure fuel line such that the high pressure portion of the double-walled fuel line seals with the member to form a continuous high pressure passage; and at least one third opening that opens toward a direction substantially orthogonal to the longitudinal axis; and a fuel collection manifold around the main body and having a channel between the third opening and an outer surface of the fuel collection manifold such that a low pressure passage for fuel leaking from the double-walled fuel line extends from the channel through the third opening.

16. The connector of claim 15, wherein the fuel collection manifold is integrally formed with the main body.

17. The connector of claim 15, wherein the fuel collection manifold is rotatable about the longitudinal axis.

18. The connector of claim 15, wherein the fuel collection manifold is detachably connected to the main body and has an inner surface, said inner surface sealingly positioned about an outer surface of the main body.

19. The connector of claim 18, wherein the fuel collection manifold is attachable to the main body by inserting the main body into an opening in the fuel collection manifold, said main body including a stop preventing insertion of the main body beyond a predetermined position, and the fuel collection manifold including a profile feature positioned on an outer surface of the main body for attaching a retaining mechanism that locks the fuel collection manifold substantially at said predetermined position.

20. A leak containment system, comprising:

a single-walled high pressure accumulator including a high pressure cavity;

a double-walled line including a high pressure line, a jacket surrounding the high pressure line, an annular region between the high pressure line and the jacket, and a line connector housing a portion of the double-walled line and configured to fluidly attach the double-walled line to the single-walled high pressure accumulator;

a drain line;

a leakage drain connector having a first end sealingly attached to the single-walled high pressure accumulator, a second end sealingly attached to the line connector, and a side portion fluidly connected to the leakage drain line, said leakage drain connector housing a portion of the high pressure line;

a leakage detector fluidly coupled to the drain line;

a continuous high pressure passage including the high pressure cavity fluidly connected to the high pressure line; and a continuous low pressure passage including the annular region, the drain line, and interior regions of the leakage drain connector and the line connector outside the housed high pressure line.

21. The fuel system of claim 1, wherein each of the fuel line connectors of the double-walled fuel line segments is spaced apart from each of the plural members of the single-walled high pressure common rail.

22. The fuel system of claim 20, wherein the leakage drain connector is coupled to an outer surface of the line connector.

23. The fuel system of claim 1, wherein the plural members are integral with the main body of the single-walled high pressure common rail.

24. The fuel system of claim 1, further comprising plural fuel collection manifolds coupled to an outer surface of respective leakage drain connectors, and a first end of each leakage drain connector is coupled to a respective one of the plural members and extends outwardly from a respective one of the fuel collection manifolds, and a second end of each leakage drain connector is coupled to a respective one of the fuel line connectors and extends outwardly from the respective one of the fuel collection manifolds.

25. The fuel system of claim 1, wherein each leakage drain connector has a first opening at a first end to receive a respective one of the plural members, a second opening at a second end to receive a respective one of the fuel line segments, and a third opening intermediate the first and second openings.

26. The fuel system of claim 25, wherein the third opening of each leakage drain connector is fluidly coupled to the fuel drain line.

* * * * *